United States Patent [19]

Roach

[11] 4,437,713

[45] Mar. 20, 1984

[54] TREE ORNAMENT CONTAINER

[76] Inventor: Bobbie R. Roach, 621 Dunwich Way, Baltimore, Md. 21221

[21] Appl. No.: 335,704

[22] Filed: Dec. 30, 1981

[51] Int. Cl.[3] ..... A47B 43/00; B65D 5/22

[52] U.S. Cl. ..... 312/259; 312/209; 312/261; 229/34 R; 206/491

[58] Field of Search ..... 312/259, 258, 261, 111, 312/209; 229/34 R, 34 HW, 38, 35; 206/491

[56] References Cited

U.S. PATENT DOCUMENTS

| | | | |
|---|---|---|---|
| 114,752 | 5/1871 | Beer | 312/261 |
| 633,318 | 9/1899 | Horle | 312/261 |
| 1,668,234 | 5/1928 | Fancher | 206/491 |
| 2,218,360 | 10/1940 | Rokol | 206/491 |
| 2,768,776 | 10/1956 | Weiss | 229/34 R |
| 2,914,235 | 11/1959 | Jones | 229/34 R |
| 3,287,075 | 11/1966 | Batke et al. | 312/111 |
| 3,381,878 | 5/1968 | Dewhurst | 229/34 R |
| 3,576,355 | 4/1971 | Stone | 312/259 |
| 3,784,083 | 1/1974 | Pfaffendorf et al. | 229/34 R |
| 4,065,021 | 12/1977 | Kedzierski | 312/209 |
| 4,269,461 | 5/1981 | Roach | 312/244 |

*Primary Examiner*—Victor N. Sakran

*Attorney, Agent, or Firm*—John F. McClellan, Sr.

[57] ABSTRACT

A Christmas tree ornament holding container has an open-side box into which laterally fit a plurality of hold-around shelves into which similarly fit a respective plurality of fold-and-lock drawers, which may have respective conventional design grid separators for the ornaments; finger grip holes for pulling out the drawers may be provided on each end of each drawer; the drawers preferably being symmetrical about the lateral centerline and the longitudinal centerlines.

1 Claim, 6 Drawing Figures

TREE ORNAMENT CONTAINER

FIELD OF THE INVENTION

This invention relates to containers generally and to Christmas tree ornament holders specifically.

BACKGROUND OF THE INVENTION

My U.S. Pat. No. 4,269,461 issued May 26, 1981 for CHRISTMAS TREE TRIM CABINET discloses a Christmas tree ornament holder in the form of a transparent open-front frame with transparent sliding drawers contained on partial shelves; each drawer has a hand-grip opening in front, and a number of the drawers have "Styrofoam" forms inside shaped and sized fitting and holding lower portions of Christmas tree balls and the like. A sliding door secures the drawers in place.

Although ideal for storing and for displaying for sale Christmas tree ornaments, my patented invention is relatively expensive to make at the present time although newer, less costly transparent plastic may make it competitive in price in the future.

OBJECT OF THE PRESENT INVENTION

A principal object of the present invention is to provide a Christmas tree ornament container which is protectively strong and rigid but is economical to produce so that it can be sold in large numbers at a relatively low price.

Further objects of this invention are to provide a container which is quick and positive in assembly and can be stored any side up with good resistance to external loads, but which is light in weight and assembled using some parts that can be shipped flat, and all parts of which are of corrugated board.

In brief summary given as cursive description only and not as limitation the invention includes an open-side box with fold-around stacking shelves containing folding lockingtab equipped drawers having ornament separators inside the drawers.

The above and other objects of this invention will become more readily apparent on examination of the following description.

DETAILED DESCRIPTION

Figure 1:
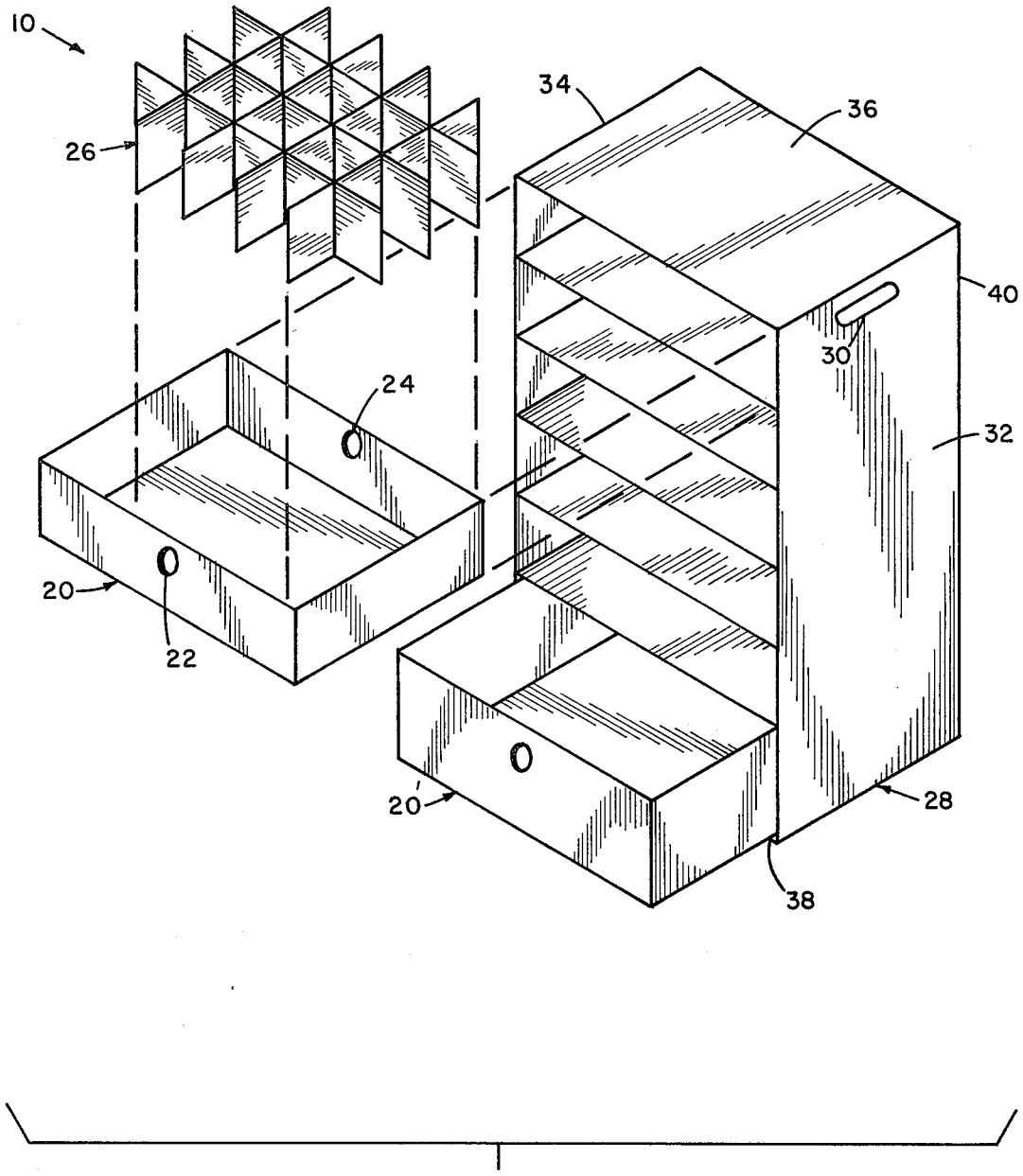
FIG. 1 is an exploded perspective schematic showing general relation of some elements of the invention.

FIG. 1 diagrams relation of parts of the invention 10 shown schematically. All parts are preferably of corrugated paper board. Each drawer 20 preferably has a finger-grip opening 22 centrally in the front and similarly at 24 in the back, and preferably is equipped with a rectangular grid 26 or Christmas tree ornament separator which fits downwardly (broken lines) into the drawer and provides visual and removing access from the top.

Height of the grid should be sufficient to fit down flush in the drawer. Broken lines indicate fit of drawers like 20 into the box 28. The bottom drawer 20' is preferably greater in height than the others and fits in a similar-shape drawer opening in the open box 28. The open-side box 28 has a lifting cutout 30 on the upper part of each side 32, 34; and a top 36, bottom 38 and back 40.

Figure 2:
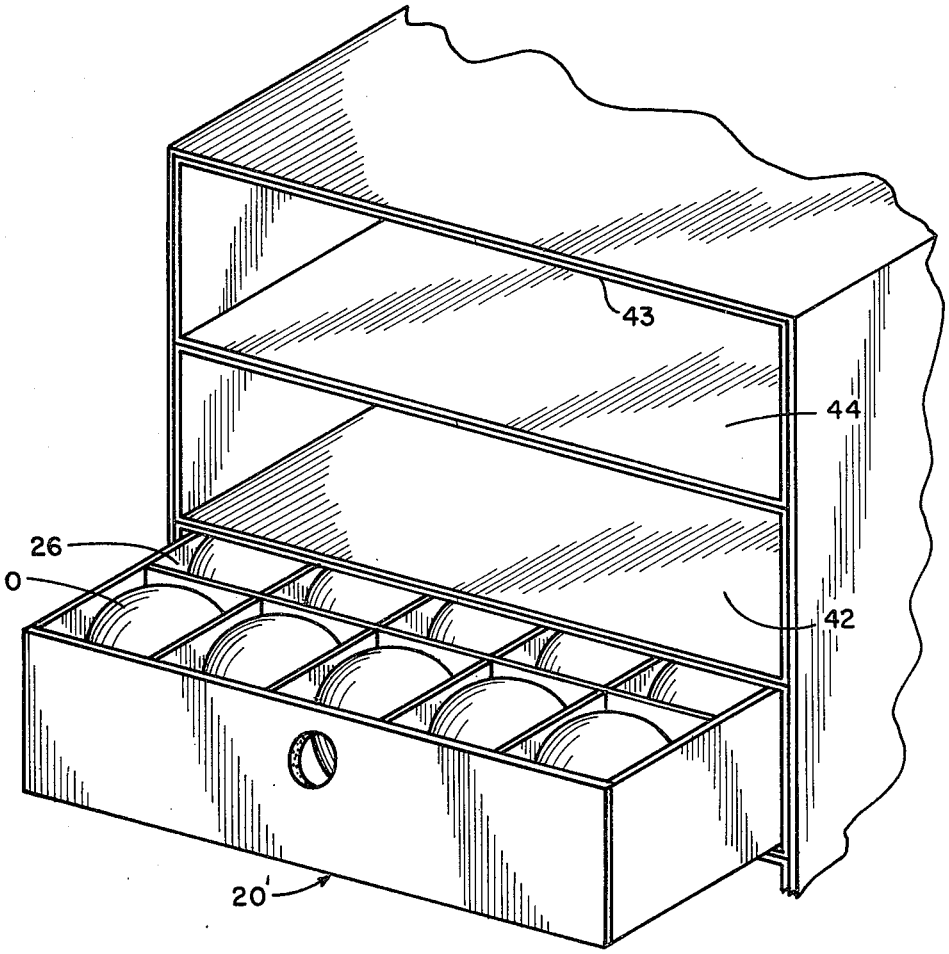
FIG. 2 is a fragmentary perspective assembly detail.

FIG. 2 shows a typical drawer 20' with the grid 26 separating Christmas tree ornaments "0" in it. Forming a plurality of drawer receiving spaces 42 are a plurality of shelves 44, each as shown resting on one below it, and each formed of a flat sheet of corrugated paperboard folded-around with free ends abutting as at 43 to make a rectangular tube for receiving a drawer. When assembled in close-fit within the box, these tubes greatly strengthen and stiffen the box and protect the contents.

Figure 3:
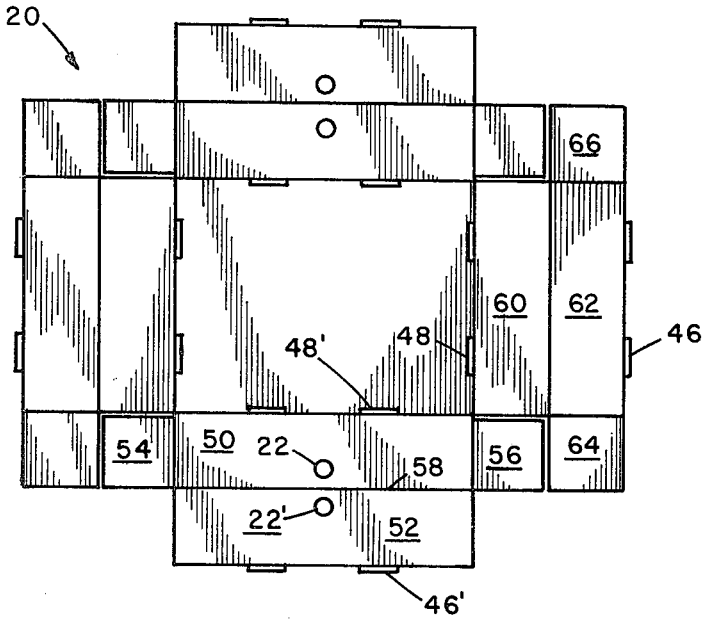
FIG. 3 is a plan detail of a drawer as made.

FIG. 3 shows a drawer 20 in the form of a flat sheet before it is folded up along the fold lines or creases and held in drawer shape by tabs 46 in slots 48 to comprise the desired drawer shape. When flat as shown it is economical of waste, being in the general shape of a broad cross as defined by the small amount of scrap removed at the corners.

As will be described later, the fold-up procedure (one side only being referred to) follows these steps:

(a) fold-up as a unit to 90° end parts 50, 52, 54, 56 these, are double parts with a fold line 58 between and the side parts or, locking flaps 54, 56 laterally on the inner of the double parts;

(b) fold-in to 90° locking flaps 54, 56.

(c) fold-up as a unit to 90° side parts 60, 62, 64, 66;

(d) fold-in another 90° side parts 62;

(e) fold-up 90° locking flaps 64, 66; these are laterally on the outer portions 62;

(f) fold-in to 180° from elements 60 the elements 62 covering end parts 56, and tuck the tabs 46 into slots 48;

(g) fold over to 180° from end parts 50 the end parts 52, covering side parts 64; and (h) tuck the end-part tabs 46' into slots 48'.

This completes drawer assembly. Holes 22, 22' will then be congruent. A similar process completes the other end of the drawer. It can be appreciated that unique strength, rigidity and toughness derive from this structure in which both the ends and sides are double and in which each interlocks with two small side pieces 54, 56, 64, 66) of the other as well as with the tabs, making cementing unnecessary.

Figure 4:
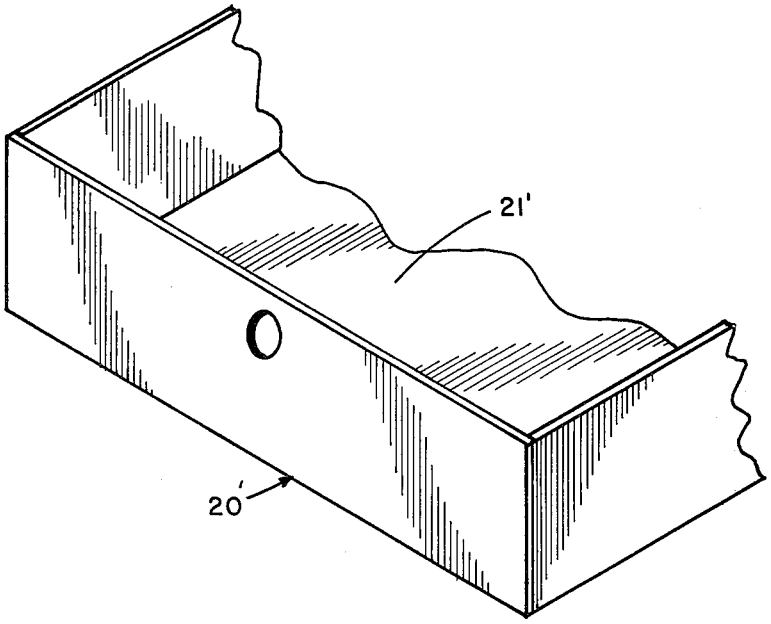
FIG. 4 is a schematic fragmentary detail of a drawer corner.

FIG. 4 indicates that the interior 21' of a drawer is uncluttered by extraneous seams or overlaps.

Figure 5:
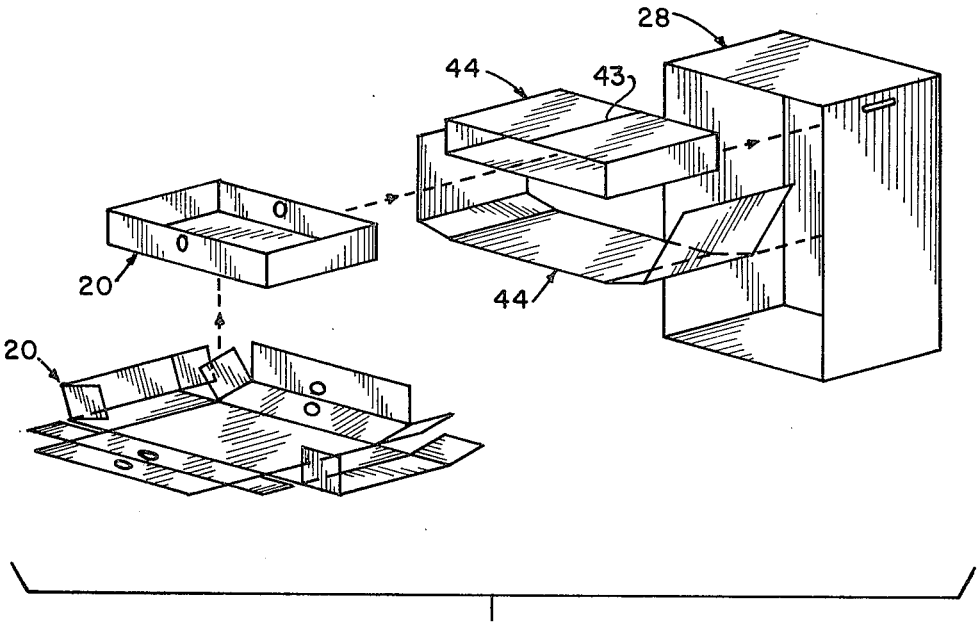
FIG. 5 is a further exploded perspective view indicating assembly sequence.

FIG. 5 indicates in more detail than the first Figure the assembly relations.

Drawer 20 is shown partially folded and then (arrows) fully folded ready to be inserted (arrows) into a fold-around shelf 44 (shown partially folded below and (arrow) fully folded above ready for insertion into box 28 which is empty.

Figure 6:
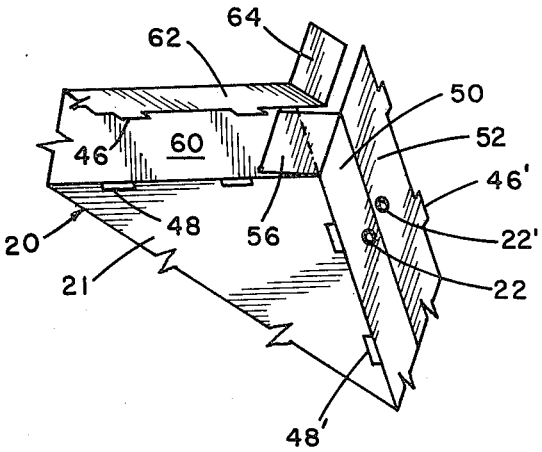
FIG. 6 is a fragmentary detail indicating folding assembly of a corner of a drawer.

FIG. 6 is a fragmentary view which shows a corner of a drawer 20 with the parts in relation after step (e) for step (f) in which side part 62 will be folded down over end part 56. Next tabs 46 will be tucked into slots 48 and finally end part 52 will be folded down over side part 64 and tabs 46' tucked into slots 48', completing drawer assembly.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a Christmas tree ornament container of corrugated paper board having an opensided box with a plurality of shelves therein for holding drawers, and a plurality of said drawers having Christmas tree ornament separators therein, each said drawer having a plurality of tabs, fold-up sides and fold-up ends held by insertion of tabs in slots, each of said fold-up sides and fold-up ends being a double part, with a fold line between each of the double-parts of the sides and of the ends, a respective pair of locking flaps held between each of said double-part fold-up sides and fold-up ends, the improvement comprising: each said shelf being a fold-around rectangular tube with ends abutting and proportional for stacked fitting in said box with a said drawer in said fold-around rectangular tube, each of said drawers being symmetrical side-to-side and end-to-end, and each drawer being, when unfolded, generally in the shape of a broad cross.

* * * * *